US006607453B1

(12) United States Patent
Bissonnette et al.

(10) Patent No.: US 6,607,453 B1
(45) Date of Patent: Aug. 19, 2003

(54) GOLF BALLS WITH A FUSED WOUND LAYER AND A METHOD FOR FORMING SUCH BALLS

(75) Inventors: Laurent Bissonnette, Portsmouth, RI (US); William E. Morgan, Barrington, IL (US); Emanuel Vieira, New Bedford, MA (US); Roman Halko, Natick, MA (US)

(73) Assignee: Acushnet Company, Fairhaven, MA (US)

( * ) Notice: Subject to any disclaimer, the term of this patent is extended or adjusted under 35 U.S.C. 154(b) by 139 days.

(21) Appl. No.: 09/610,608

(22) Filed: Jul. 5, 2000

(51) Int. Cl.[7] ..... A63B 37/06
(52) U.S. Cl. ..... 473/357
(58) Field of Search ..... 473/356–366

(56) References Cited

U.S. PATENT DOCUMENTS

| | | | | | |
|---|---|---|---|---|---|
| 2,499,344 | A | * | 2/1950 | Smith | 473/356 |
| 2,730,159 | A | * | 1/1956 | Semegen | 473/356 |
| 3,119,622 | A | | 1/1964 | Weigert | 273/227 |
| 3,134,598 | A | | 5/1964 | Muccino | 273/227 |
| 4,572,507 | A | | 2/1986 | Hubbert et al. | 273/60 R |
| 4,783,078 | A | | 11/1988 | Brown et al. | 273/216 |
| 4,938,471 | A | * | 7/1990 | Nomura et al. | 473/356 |
| 5,020,803 | A | | 6/1991 | Gendreau et al. | 273/225 |
| 5,194,191 | A | * | 3/1993 | Nomura et al. | 473/356 |
| 5,201,523 | A | | 4/1993 | Miller | 273/233 |
| 5,713,801 | A | | 2/1998 | Aoyama | 473/354 |
| 5,749,796 | A | | 5/1998 | Shimosaka et al. | 473/365 |
| 5,759,676 | A | | 6/1998 | Cavallaro et al. | 428/215 |
| 5,823,890 | A | | 10/1998 | Maruko et al. | 473/354 |
| 5,888,157 | A | | 3/1999 | Guenther et al. | 473/604 |
| 6,142,885 | A | * | 11/2000 | Umezawa et al. | 473/365 |

* cited by examiner

*Primary Examiner*—Mark S. Graham
*Assistant Examiner*—Raeann Gorden
(74) *Attorney, Agent, or Firm*—Swidler Berlin Shereff Friedman, LLP

(57) ABSTRACT

The present invention is directed towards a golf ball and a method of making the golf ball, which comprises a center and at least one fused, wound layer. The fused wound layer can be a cover layer or an intermediate layer. In one embodiment, the fused wound layer surrounds the center to form a wound core and a cover surrounds the core. In another embodiment the fused wound layer forms the outer surface of the ball. The method of the present invention allows the characteristics of the wound layer to be altered and controlled after the wound layer has been formed. In the method, fusing occurs by applying heat alone or with pressure to the wound core. In one embodiment, fusing can occur during formation of the cover layer. In one embodiment, single, double, multi-ply or multi-strand thread is used. The cross-sectional shape and area of the thread can be, for example, rectangular or circular.

25 Claims, 9 Drawing Sheets

GOLF BALLS WITH A FUSED WOUND LAYER AND A METHOD FOR FORMING SUCH BALLS

TECHNICAL FIELD OF THE INVENTION

This invention relates generally to golf balls, and more particularly to golf balls having a fused wound layer and a method for forming such balls.

BACKGROUND OF THE INVENTION

Conventional golf balls can be divided into two general types of groups: solid balls or wound balls (also known as three piece balls). The difference in play characteristics resulting from these different types of constructions can be quite significant. Balls having a solid construction are generally most popular with the average, recreational golfer because they provide a very durable ball while also providing maximum distance. Solid balls are generally made with a single solid core usually made of a cross linked rubber, which is enclosed by a cover material. Typically the solid core is made of polybutadiene which is chemically crosslinked with zinc diacrylate and/or similar crosslinking agents and is covered by a tough, cut-proof blended cover. The cover is generally a material such as SURLYN®, which is a trademark for an ionomer resin produced by DuPont de Nemours & Company. The combination of the core and cover materials provide a "hard" ball that is virtually indestructible by golfers. Further, such a combination imparts a high initial velocity to the ball which results in increased distance. Because these materials are very rigid, solid balls can have a hard "feel" when struck with a club. Likewise, due to their construction, these balls have a relatively low spin rate which provides greater distance.

At the present time, the wound ball remains the preferred ball of the more advanced player due to spin and feel characteristics. Wound balls typically have either a spherical solid rubber or liquid center around which many yards of a stretched elastic thread are wound forming a wound core. The wound core is then covered with a durable cover material such as a SURLYN® or similar material or a softer cover, such as Balata or polyurethane. Wound balls are generally softer and provide more spin, which enable a skilled golfer to have more control over the ball's flight and position. Particularly, with approach shots onto the green, the high spin rate of soft, wound balls enable the golfer to stop the ball very near its landing position.

To make wound golf balls, manufacturers use winding machines to stretch the threads to various degrees of elongation during the winding process without subjecting the threads to unnecessary incidents of breakage. Generally, as the elongation and the winding tension increases, the compression and initial velocity of the ball increases. Thus, a more resilient wound ball is produced, which is desirable.

Generally, the prior art has been directed to making wound golf ball cores and golf balls using single-ply or two-ply polyisoprene thread. The polyisoprene thread is wound onto the centers at elongations between about 500–1000%. The amount of thread required for a golf ball core is dependent on the elastic modulus of the thread in the elongated state. Elongated polyisoprene thread has an elastic modulus between 10 and 20 ksi. The resilience, compression, spin characteristics and other properties of the golf ball are dependent on many factors. One significant factor is the packing density (i.e., how well the thread packs during winding). The winding pattern, geometry and tension of the thread determine the packing density. For conventional golf balls, properties of the windings, such as resilience, modulus of elasticity, and density are not altered after winding. As a result, the resilience, compression, spin characteristics and other properties of the ball are partly set after winding and remain unalterable. However, in certain situations it is desirable to be able to alter the above-mentioned properties of the ball after winding has been completed.

Regardless of the form of the ball, players generally seek a golf ball that maximizes total game performance for their requirements. Therefore, in an effort to meet the demands of the marketplace, manufacturers strive to produce golf balls with a wide variety of performance characteristics to meet the players individual requirements. Thus, golf ball manufacturers are continually searching for new ways in which to provide golf balls that deliver the maximum performance for golfers of all skill levels. One such improved golf ball is the subject of the present invention.

SUMMARY OF THE INVENTION

The present invention is directed to a golf ball with a center; and at least one fused wound layer surrounding the center. The fused wound layer can be a cover layer or an inner layer. The wound layer is formed by at least one thread and adjacent portions of the thread are fused together. The thread can be continuous.

In one embodiment, the wound layer further comprises a first thread and a separate, second thread, wherein at least one of the threads is a fusible material and the other thread is non-fusible, or both are fusible so that portions of the wound layer are fused.

In one embodiment, at least one cover layer is formed around the wound layer. Generally, the cover layers are applied by compression molding, injection molding or casting cover material over the core.

In yet another embodiment, the ball further includes at least one intermediate layer between the wound layer and the cover layer. In an additional alternative embodiment, the ball includes two or more fused, wound layers, and the ball can include a separate cover or the outer surface can be formed by one of the wound layers.

In another embodiment, the fused wound layer forms the outer surface of the ball so that no separate cover is used.

In an additional embodiment, the wound layer includes a radially extending fused portion, which forms from about 10% to about 100% of the thickness of the wound layer.

The present invention is further directed to a method of forming a golf ball, the method comprising the steps of: winding a thread onto a center to form a wound layer; and fusing portions of the thread together.

In an alternative embodiment, the step of winding further includes applying tension to the thread.

Furthermore, the fusing is accomplished by applying heat alone or with pressure. As a result, the fused threads are chemically, physically, and/or mechanically changed. The step of applying heat may further include at least one of the following: compression molding, injection molding, compression and injection molding, or infrared heating. The heat can be applied simultaneously with forming the cover layer.

In one embodiment, the pre-fused diameter of the wound core is greater than the post-fused diameter of the wound core or ball.

The present invention is also directed to a method of forming a golf ball, wherein the method comprises the steps of: selecting a center; winding a thread onto the center to form a wound layer with at least one property; and altering the properties of a radially extending portion of the wound layer by applying heat after completing the winding step. The step of altering the properties of the wound layer can further include altering the density of the radially extending portion or altering the elongated state of the thread in the radially extending portion.

DETAILED DESCRIPTION OF THE PREFERRED EMBODIMENTS

Figure 1:
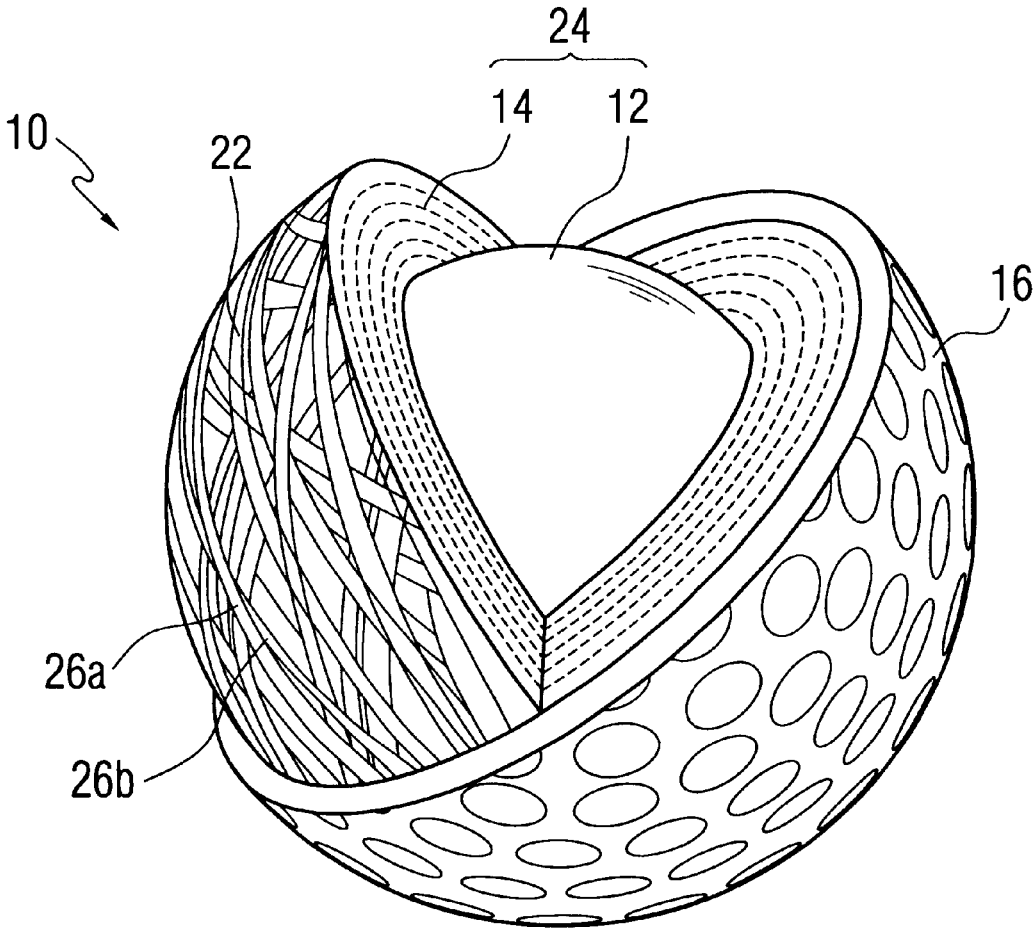
FIG. 1 is a perspective view of a golf ball according to the present invention with a portion cut away for clarity to view a solid center and a wound layer of the ball.
Figure 2:
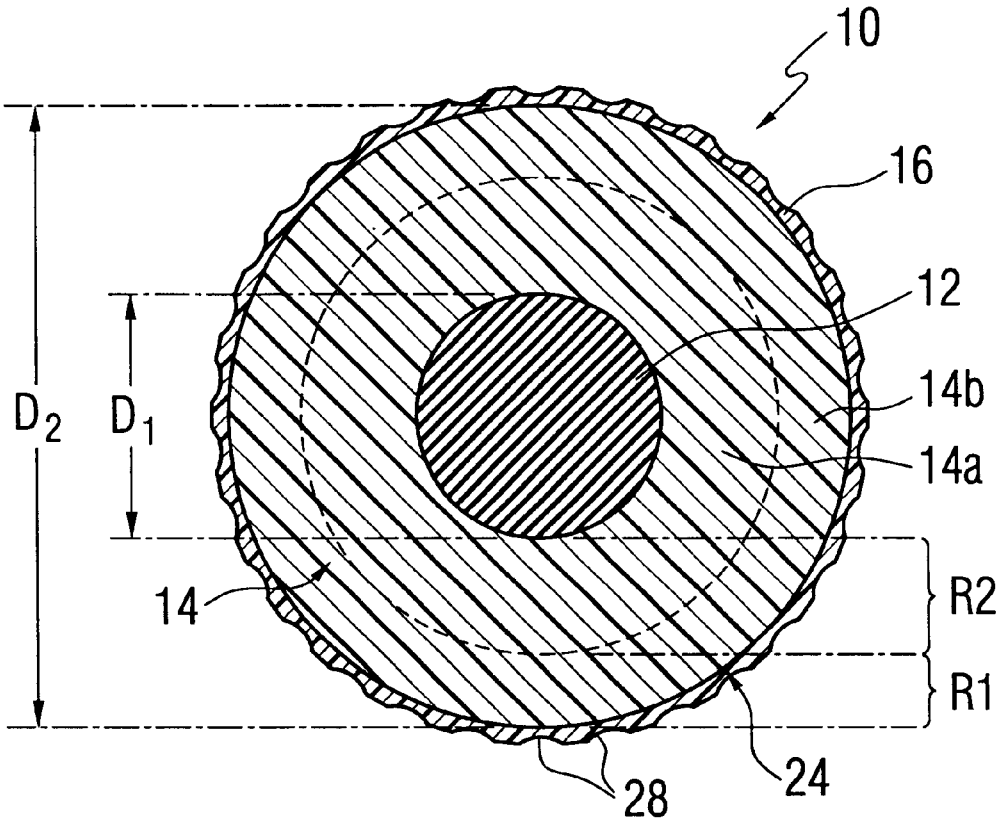
FIG. 2 is a cross-sectional view of the golf ball of FIG. 1.

Turning to FIGS. 1 and 2, a golf ball 10 of the present invention is shown. The golf ball includes a solid center 12, a wound layer 14, and at least one cover layer 16. At least one thread 22 is wound onto center 12 to form a wound core 24 that includes the wound layer 14 and the center 12. Preferably, a plurality of windings 26*a* and 26*b* surround center 12, where one winding is generally defined as one circumferential loop of thread 22 wrapped around the center 12. Wound layer 14 defines an un-fused portion 14*a* and a substantially fused portion 14*b*. The cover 16 surrounds the wound core 14 and is of any dimension or composition. The cover 16 defines dimples 28 on the outer surface 30 of the ball.

Figure 3:
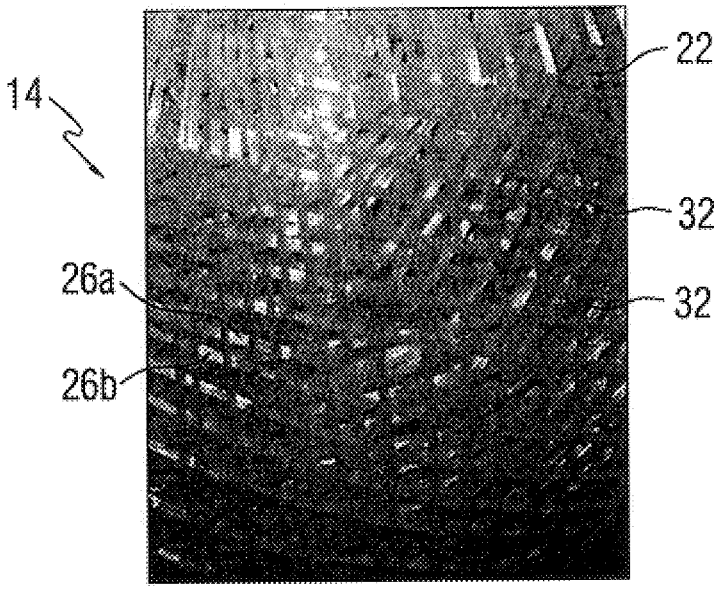
FIG. 3 is a partial photographic representation of the golf ball with a wound layer shown before fusing.
Figure 4:
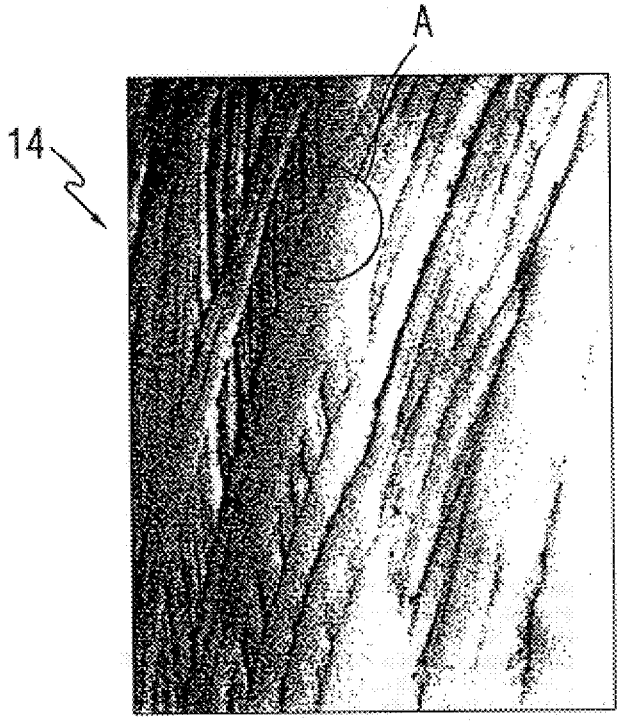
FIG. 4 is an enlarged photographic representation of the golf ball with a wound layer shown after fusing.

Referring to FIGS. 3 and 4, a portion of the wound layer is shown before and after fusing, respectively. FIG. 3 shows a partial photographic representation of the wound layer 14 before fusing, where the wound layer consists of one continuous thread 22 and portions of the thread, such as portions of windings 26*a* and 26*b*, overlap and are adjacent and separate. Air spaces or interstices 32 exist between portions of the thread. FIG. 4 shows wound layer 14 after fusing where portions of the thread are joined together, as can be seen within region A, and preferably no air spaces or interstices are between fused portions of the thread.

During fusing, at least a portion of the thread is exposed to a temperature that is higher than the heat distortion temperature of the thread such that the windings undergo a change in state, causing them to soften or melt. The thread loses shape and/or liquefies and flows within the interstices 32 of the wound layer and solidifies to create a more unified arrangement, or fused portion of the wound layer. The diameter of the wound layer 14 is smaller after fusing than before fusing. At least portion 26*a* of the thread, which was once discrete and separate, joins or fuses to adjacent portion 26*b* of the thread, as can be seen generally at region A in FIG. 4. After fusing, adjacent portions of the thread stick together. The adjacent portions can be side-by-side as shown or overlapped. Furthermore, the wound layer 14 may be fused to a radially adjacent non-thread layer, such as the center 12 or the cover 16, where the thread as described above, bonds to the radially adjacent non-thread layer. It should be noted that one skilled in the art will recognize that control of the depth of fusing is an important parameter in controlling ball properties.

Figure 5A:
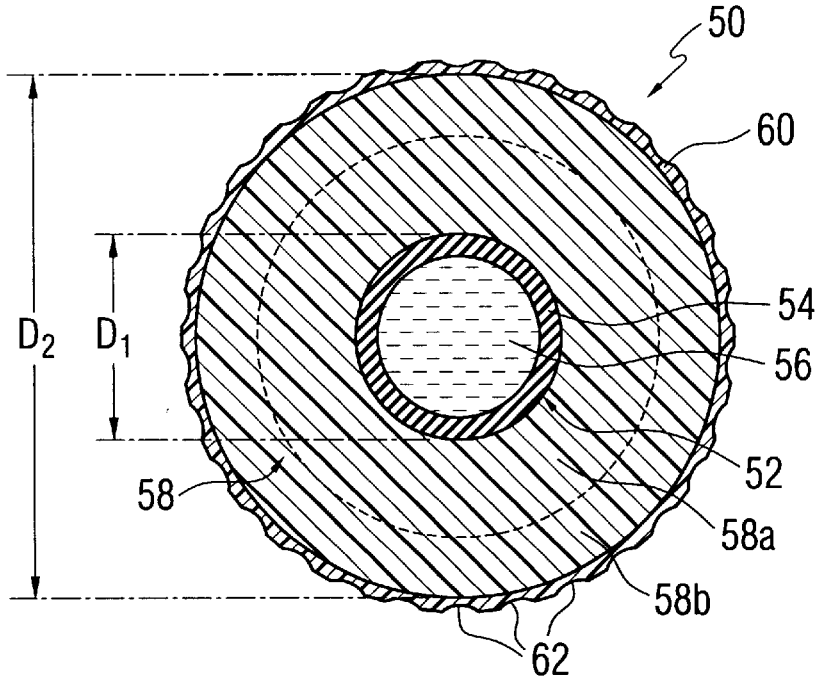
FIG. 5A is a cross-sectional view of an alternative embodiment of a golf ball according to the present invention wherein the center is fluid-filled.

Referring to FIG. 5A, an alternative embodiment of a golf ball 50 is shown. Ball 50 includes a fluid-filled center 52 formed of an envelope or shell 54 filled with fluid 56. At least one thread is wound onto center 52 to form a wound layer 58 surrounding the center 52. The wound layer 58 is fused as in the previous embodiment to define an un-fused portion 58*a* and a substantially fused portion 58*b*. A cover 60 surrounds the wound layer 58. The cover 60 has dimples 62 defined therein.

Figure 5B:
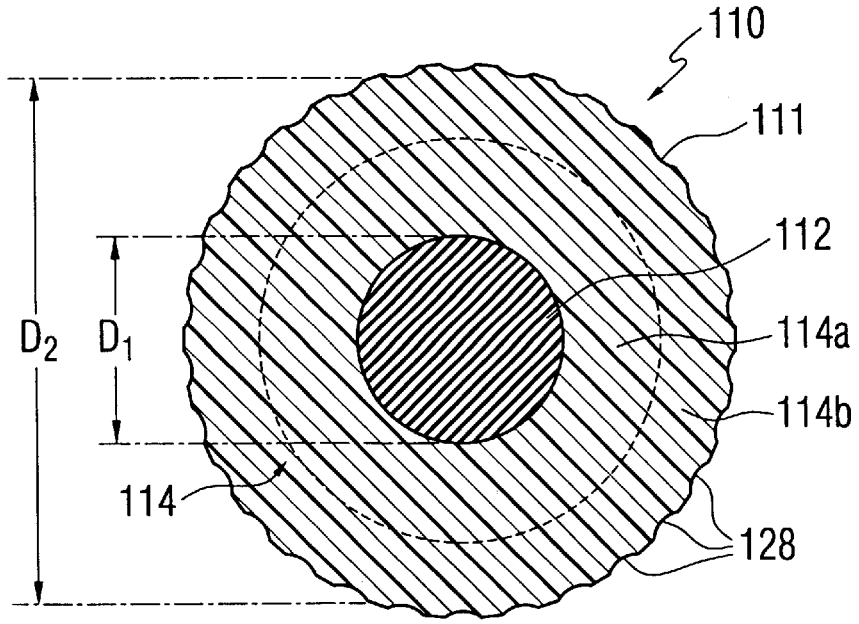
FIG. 5B is a cross-sectional view of an alternative embodiment of a golf ball according to the present invention wherein the wound layer forms the outer surface of the ball.

Referring to FIG. 5B, a golf ball 110 is shown with a fused wound layer 114 that forms the outer surface 111 or cover, thereby eliminating the need for a separate cover layer. The center 112 is solid, however, a fluid-filled center as shown in FIG. 5A can alternatively be used. The thread, as described above, is wound around center 112 and at least a portion of the thread is fused together to form a fused wound layer 114 that defines an un-fused portion 114*a* and a substantially fused portion 114*b*. The fused wound layer 114 constitutes the outer surface 111 of the golf ball 110. Preferably, the fused wound layer is textured on the outer surface 111 by, for example, microscopic surface roughness, dimples, or bramble patterns or some combination thereof. Most preferably, the outer surface 111 of the fused wound layer 114 defines dimples 128. Dimples 128, can have various shapes such as circular, oval, constant depth, circular or non-circular cross-section, or polygonal. It is preferred that when the fused wound layer forms the outer surface that it exhibit a Shore D hardness of between about 30 and about 80. More preferably, the Shore D hardness is between about 45 and about 68.

Figure 6:
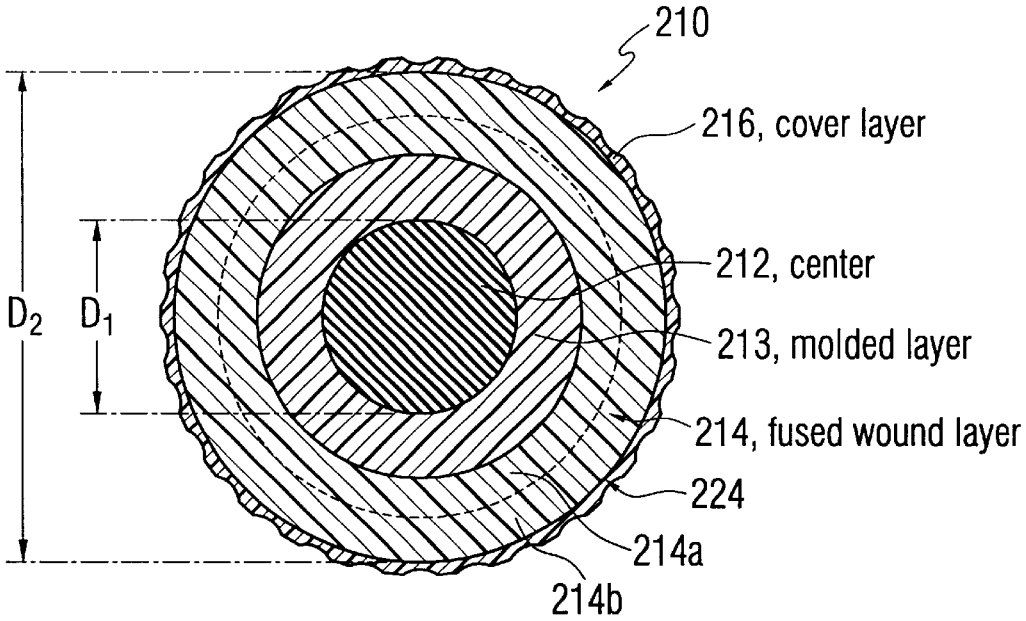
FIG. 6 is a cross-sectional view of another alternative embodiment of a golf ball according to the present invention.

FIG. 6 shows an alternative embodiment of a golf ball 210 according to the present invention having an intermediate layer 213 formed over a center 212. The center 212 can be solid or fluid-filled (not shown). Preferably, the intermediate layer 213 is molded; however, it can also be wound.

A wound layer 214 is formed of thread so that the wound layer surrounds the intermediate layer 213 and forms a wound core 224. At least a portion of thread is fused together to fuse the wound layer 214 as previously described, and defines an un-fused portion 214*a* and a substantially fused portion 214*b*. A cover 216 surrounds the wound core 224, as previously described. Alternatively, the fused wound layer 214 surrounding center 212 and intermediate layer 213 may form the outer surface, as shown in FIG. 5B.

Figure 6A:
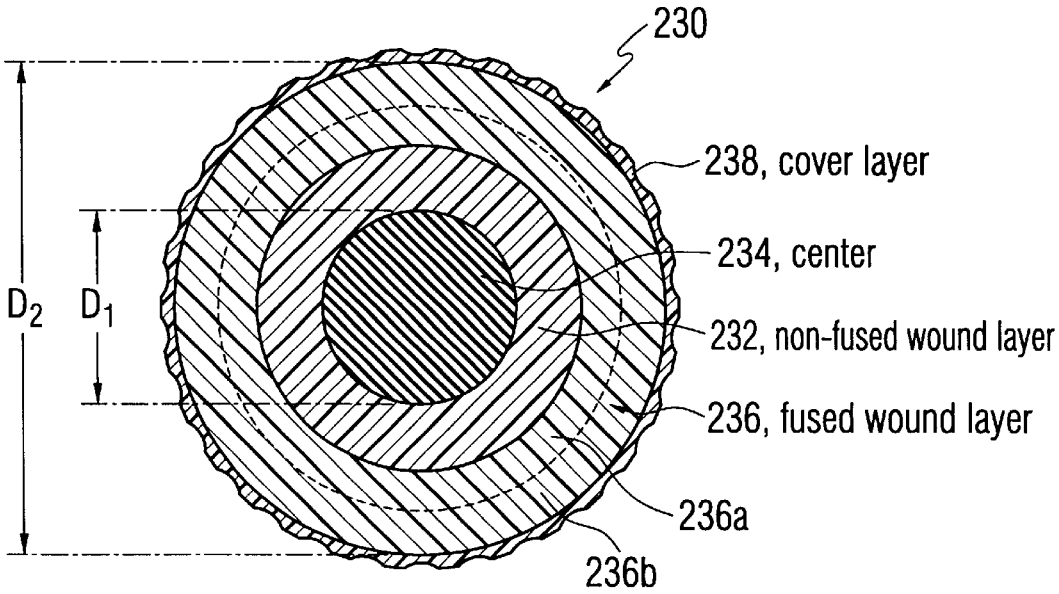
FIGS. 6A–6C are cross-sectional views of other alternative embodiments of a golf ball according to the present invention.

Moreover, there are many variations of the golf ball of FIG. 6. As can be seen in FIG. 6A, golf ball 230 can be made by forming a conventional non-fused wound layer 232 immediately adjacent the center 234, with a fused wound layer 236 that defines an un-fused portion 236*a* and a substantially fused portion 236*b*, over the conventional non-fused wound layer 232, then applying a cover layer 238 thereto.

Figure 6B:
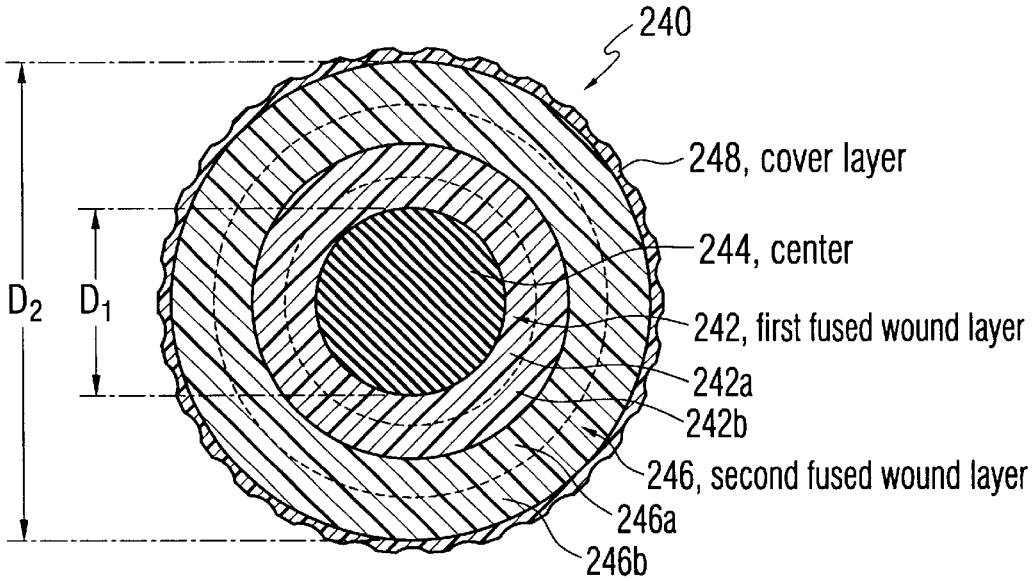

Referring to FIG. 6B, alternatively golf ball 240 is formed by forming a first fused wound layer 242 adjacent the center 244. Fused wound layer 242 defines an un-fused portion 242*a* and a substantially fused portion 242*b*. A distinct second fused wound layer 246 could be formed over the first fused wound layer 242, then forming a cover layer 248 thereover. Fused wound layer 246 defines an un-fused portion 246*a* and a substantially fused portion 246*b*.

Figure 6C:
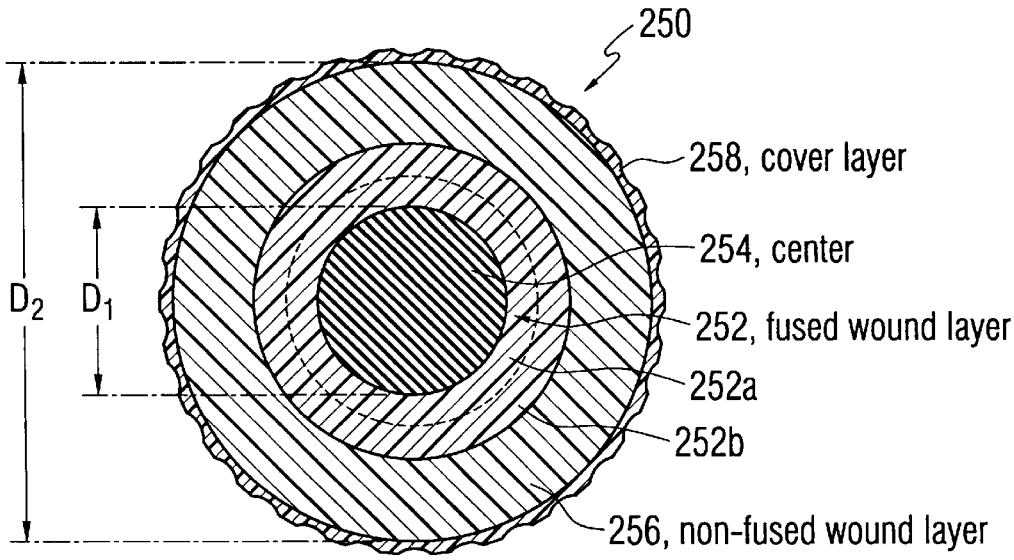

Referring to FIG. 6C, golf ball 250 is yet another embodiment where a first fused wound layer 252 is formed over a center 254 and a second non-fused wound layer 256 is formed over the first fused wound layer 252, and a cover layer 258 is formed over non-fused wound layer 256. Fused wound layer 252 defines an un-fused portion 252*a* and a substantially fused portion 252*b*. Furthermore, it is conceivable that instead of two wound layers, a solid, molded layer or layers could be formed between the fused wound layer and the cover. As a result, the fused wound layer may be used as an alternative to thin molded thermoplastic mantles. The center can also be fluid-filled. Numerous materials, with respect to the center, the thread, and the cover materials could be used to form these layers, as will be discussed herein.

Figure 7:
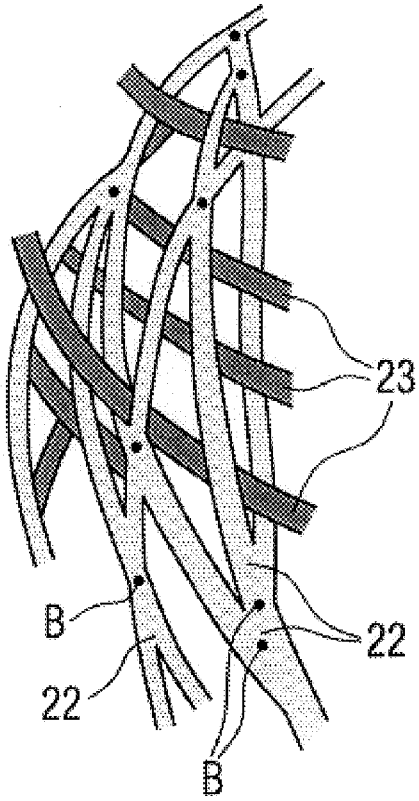
FIG. 7 is an enlarged, partial, perspective view of a wound layer comprising two threads after fusing.

Furthermore, golf ball 10 of FIGS. 1 through 4 can have multiple threads wound about a center 12 to form the wound layer 14. Each thread has a plurality of portions, which surround the center 12. Portions of at least one of the threads are fused together to form the fused wound layer 14 as previously described. For example, as can be seen in FIG. 7, a thread 22 which may be fused ("fusible thread") can be used in combination with a thread 23 that cannot be fused ("non-fusible thread"). In this regard a portion of the fusible thread 22 fuses together and weaves or interlocks with the non-fusible thread 23, but does not fuse or join to the non-fusible thread 23. Preferably, the fusible thread 22 is a thread that "softens" during compression and/or injection molding cycles, such as polyether urea. In addition, two fusible threads may be used such that at least a portion of one fusible thread fuses to a portion of the other fusible thread. Thus, the golf ball according to the present invention is able to utilize the characteristics of multiple threads. The wound layer can be an intermediate layer or an outer surface of the ball, as discussed with respect to FIG. 5B.

Preferably, the centers 12, 112, 212, 234, 244 and 254 of FIGS. 1 through 6C have an outer diameter $D_1$ of about 0.5 to about 1.52 inches. Preferably, the wound layers 14, 114, 214, 236, 246 and 256 have an outer diameter $D_2$ after fusing of about 1.4 to about 1.62 inches. However, these dimensions can be varied to change the characteristics of the ball. For example, the centers 12, 112, 212, 234, 244 and 254 may be larger than a typical center to improve alterable characteristics such as spin and compression. The intermediate layers 213, 232, 242 and 252 (as shown in FIGS. 6–6C) can have various dimensions, as necessary.

Many different kinds of threads may be used in the ball of the present invention, including both fusible and non-fusible threads. Furthermore, the threads may be produced using a variety of processes including conventional calendering and slitting. Processes such as melt spinning, wet spinning, dry spinning and polymerization spinning may also be used to form the threads.

The fusible thread is a thermoplastic thread. Most preferably, the thread is comprised of a polymeric material. Suitable polymers include polyether urea, such as LYCRA, polyester urea, polyester block copolymers such as HYTREL, isotactic-poly(propylene), polyethylene, polyamide, poly(oxymethylene), polyketone, poly(ethylene terephthalate) such as DACRON, poly(acrylonitrile) such as ORLON, trans, trans-diaminodicyclohexylmethane and dodecanedicarboxylic acid such as QUINA. LYCRA, KYTREL, DACRON, KEVLAR, ORLON, and QUINA are available from E. I. DuPont de Nemours & Co. Generally, any thread that can be thermally fused can be used. U.S. patent application Ser. No. 09/266,847 filed on Mar. 12, 1999, entitled "Golf Ball With Spun Elastic Threads" is incorporated by reference herein in its entirety.

Non-fusible threads such as those made from thermoset materials, poly(p-phenylene terephthalamide) such as KEVLAR, rubber or natural fibers are also contemplated for use in the present invention. Glass fiber and, for example, S-GLASS from Corning Corporation can also be used. Additional non-fusible thread materials that can be used are mineral fibers such as silicates and vegetable fibers such as cellulosic and animal fibers. Preferably, the non-fusible thread 23 is a thread that does not exhibit softening during molding, such as a cross-linked polyisoprene, metal wire, graphite fibers, or the like.

Figure 8:
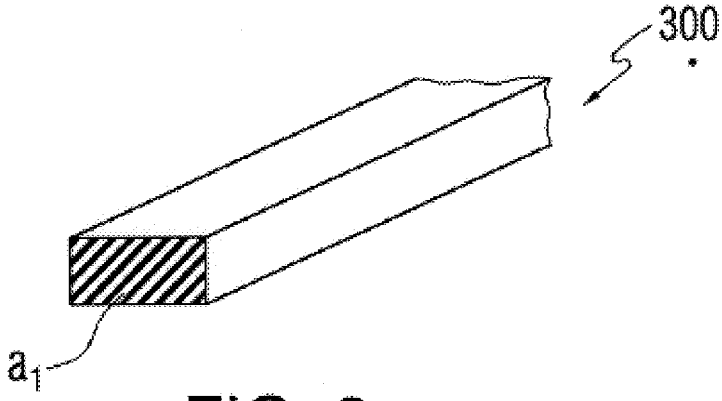
FIG. 8 is an enlarged, partial, perspective view of a single-ply thread for use in the golf ball of the present invention.

Threads used in the present invention may be of various shapes and sizes. A single-ply golf ball thread 300, as shown in FIG. 8, can be used. Typically, this thread has a generally rectangular cross-section. The area of the thread 300 is $a_1$, which in the unelongated state is preferably less than about 0.003 square inches. In the elongated state the area is about 0.0013 square inches.

Figure 9:
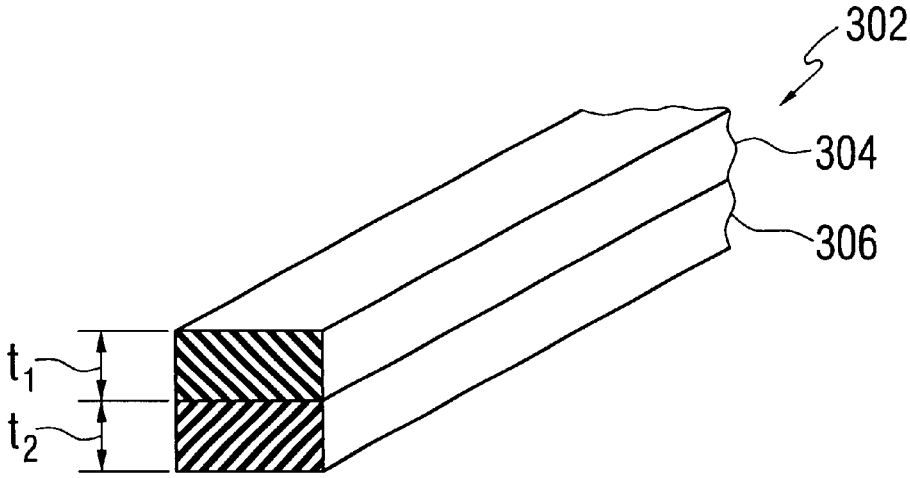
FIG. 9 is an enlarged, partial, perspective view of a two-ply thread for use in the golf ball of the present invention.

Referring to FIG. 9, a two-ply golf ball thread 302 is shown that may be used with the present invention. The first ply 304 is adjacent the ply 306. Preferably, each ply 304 and 306 of the thread 302, has a thickness $t_1$, and $t_2$, respectively. These thicknesses can be substantially the same or different. Each ply can also have the same physical properties or the composition for each ply of the thread can be different. For example, the first ply 304 can be more resilient and the second ply 306 can be more processible, so that each ply has different physical and mechanical properties. The preferred thickness of one ply with respect to the other ply depends on the performance requirements of the ball.

Figure 10:
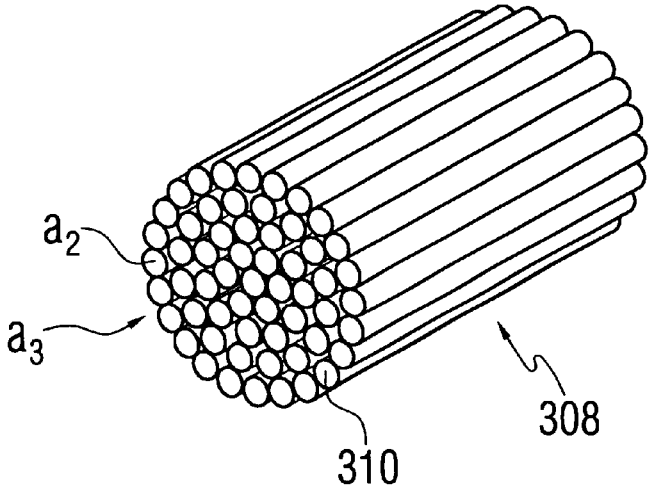
FIG. 10 is an enlarged, partial, perspective view of a multi-strand thread for use in the golf ball of the present invention.

FIG. 10 shows another type of thread 308 that may be used in the present invention. Thread 308 comprises many individual filaments or strands 310 with substantially circular cross-sections. Preferably over ten (10) strands 310 makeup the thread 308, and more preferably over fifty (50) strands 310 form the thread 308. Most preferably, the thread contains greater than one hundred (100) strands. The strands 310 have a small diameter $d_1$, typically of a diameter of less than about 0.01 inches, and more preferably less than about 0.002 inches. The cross-sectional area of the individual strands is selected as desired. The strands 310 of the thread 308 of FIG. 10 may be held together with a binder or they may be spun together. Melt spinning, wet spinning, dry spinning, and polymerization spinning may be used to produce the thread 308.

The thread 308 may also be comprised of strands 310 having different physical properties to achieve desired stretch and elongation characteristics. For example, the thread 308 may be comprised of strands of a first elastic type of material that is weak but resilient and also strands of a second elastic type of material that is stronger but less resilient. In another example, the thread 308 may be comprised of at least one, central strand of polyisoprene rubber thread having a diameter of less than 0.006 inches. This strand may be surrounded by about 10–50 polyether urea strands having diameters of less than 0.002 inches.

In a preferred embodiment, the thread 308, usable with the present invention, is formed from solvent spun polyether urea elastomer LYCRA made by E. I. DuPont de Nemours & Company of Wilmington, Del. Because this thread may be manufactured with a cross-sectional area much smaller than the isoprene threads typically used in forming the wound layer of a golf ball, as previously discussed, the thread may be used to form golf balls and cores with greater packing density and superior properties. Also, the elastic modulus of the solvent spun polyether urea thread is greater than about 30 ksi when elongated. Specifically, the elastic modulus is between about 30 to about 50 ksi when elongated between about 200 and about 400%. Elongation yielding optimal resilience of the thread is between about 200 and about 500%.

The center 12 shown in FIGS. 1, 2 and 5B is solid and formed of a thermoset rubber or a thermoplastic solid material. A representative base composition for forming the solid golf ball center 12, which is comprised of at least one layer, comprises polybutadiene and, in parts by weight based on 100 parts polybutadiene, 0–50 parts of a metal salt diacrylate, dimethacrylate, or monomethacrylate, preferably zinc diacrylate. Commercial sources of polybutadiene include Cariflex 1220 manufactured by Shell Chemical, Neocis BR40 manufactured by Enichem Elastomers, and Ubepol BR150 manufactured by Ube Industries, Ltd. If desired, the polybutadiene can also be mixed with other elastomers known in the art, such as natural rubber, styrene butadiene, and/or polyisoprene in order to further modify the properties of the center 12. When a mixture of elastomers is used, the amounts of other constituents in the core composition are based on 100 parts by weight of the total elastomer mixture. Alternatively, center 12 can be made of multiple layers.

The fluid-filled center 52, as shown in FIG. 5A, will now be discussed. Fluid-filled center 52 has an envelope or shell filled with fluid.

Any shell material capable of inhibiting or preventing fluid loss from the ball available to those of ordinary skill in the art may be used. Exemplary materials for use in the shell include thermoset or thermoplastic materials; including polyisoprene; natural rubber; a polyether-ester copolymer; castable thermoset urethanes; vinyl resins, such as those formed from polymerization of vinyl chloride or from copolymerization of vinyl chloride with vinyl acetate, acrylic esters, or vinylidene chloride; polyolefins, such as polyethylene, polypropylene, polybutylene, and copolymers such as polyethylene methacrylate, polyethylene vinyl acetate, polyethylene methacrylic or acrylic acid, polypropylene acrylic acid, or terpolymers thereof with acrylate esters and their metal ionomers; polyamides, such as poly (hexamethylene adipamide) or others prepared from diamines and dibasic acids, poly(caprolactam), PEBAX, a poly(ether-amide) block copolymer commercially available from Elf Atochem having an address in Philadelphia, Pa., and blends of polyamides with SURLYN, polyethylene or copolymers thereof, EPDM; acrylic resins; thermoplastic rubbers, such as urethanes, olefinic thermoplastic rubbers such as styrene and butadiene block copolymers or isoprene or ethylene-butylene rubber; polyphenylene oxide resins or blends thereof with polystyrene; thermoplastic polyesters, such as PET, PBT, PETG, and elastomers such as HYTREL, which is commercially available from E. I. DuPont De Nemours & Company of Wilmington, Del.; blends and alloys including polycarbonate with ABS, PBT, PET, SMA, PE elastomers, and PVC with ABS or EVA or other elastomers; blends of thermoplastic rubbers with polyethylene, polypropylene, polyacetal, nylon, polyesters, cellulose esters; metallocene catalyzed polyolefins; silicone; polybutylene terephthalate; and the like; and any combination thereof. Other shell materials include poly(ether-amide) copolymers, poly(ether-ester) copolymers; polyurethanes; metallocene catalyzed polyolefin materials, such as a maleic anhydride grafted metallocene catalyzed polyolefin; or a combination thereof.

The fluid 56 can be a wide variety of materials including air, gas, water solutions, gels, foams, hot-melts, other fluid materials and combinations thereof as set forth in U.S. Pat. No. 5,683,312 which is incorporated herein by reference. The fluid or liquid in the center is varied to modify the performance parameters of the ball, such as the moment of inertia, weight, initial spin, and spin decay.

Suitable gases include air, nitrogen and argon. Preferably, the gas is inert. Examples of suitable liquids include either solutions such as salt in water, corn syrup, salt in water and corn syrup, glycol and water or oils. The liquid can further include water soluble or dispersable organic compounds, pastes, colloidal suspensions, such as clay, barytes, carbon black in water or other liquid, or salt in water/glycol mixtures. Examples of suitable gels include water gelatin gels, hydrogels, poly vinyl alcohol, water/methyl cellulose gels and gels comprised of copolymer rubber based materials such a styrene-butadiene-styrene rubber and paraffinic and/or naphthionic oil. Examples of suitable melts include waxes and hot melts. Hot-melts are materials which at or about normal room temperatures are solid but at elevated temperatures become liquid.

The fluid can also be a reactive liquid system which combines to form a solid or create internal pressure within the envelope. Examples of suitable reactive liquids that form solids are silicate gels, agar gels, peroxide cured polyester resins, two part epoxy resin systems and peroxide cured liquid polybutadiene rubber compositions. Of particular interest are liquids that react to form expanding foams. It is understood by one skilled in the art that other reactive liquid systems can likewise be utilized depending on the physical properties of the envelope and the physical properties desired in the resulting finished golf balls.

Referring to FIG. 6, if the intermediate layer 213 molded, the intermediate layer is formed of either solid core material, cover material, or a different material. Suitable intermediate layer materials include thermosets, such as rubber, polybutadiene, polyisoprene; thermoplastics such as ionomer resins, polyamides or polyesters; or a thermoplastic elastomer. Suitable thermoplastic elastomers include Pebax®, Hytrel®, thermoplastic urethane, and Kraton®, which are commercially available from Elf-Atochem, DuPont, various manufacturers, and Shell, respectively. The intermediate layer can also be formed from a castable material. Suitable castable materials include urethane, polyurea, epoxy, and silicone. Preferably, the intermediate layer and center are formed of materials with different physical or mechanical properties or different materials. If the intermediate layer is wound, the thread materials discussed above can be used.

Referring to FIGS. 1, 2, 5A, and 6, the covers 16, 60, and 216 of golf ball embodiments 10, 50, and 210 may be of any dimension or composition. Properties that are desirable for the covers are good moldability, high abrasion resistance, high tear strength, high resilience, and good mold release, among others. The cover can be formed by compression molding, injection molding or casting depending on the material used. Preferably, the cover has a thickness to generally provide sufficient strength, good performance characteristics and durability. Preferably, the cover is of a thickness from about 0.03 inches to about 0.12 inches. More preferably, the cover is about 0.04 to about 0.09 inches in thickness and, most preferably, is about 0.05 to about 0.085 inches in thickness. The cover may have two layers where the first layer surrounds the core and the second layer surrounds the first layer. The cover may also have more than two layers.

The cover of the golf ball is generally made of polymeric materials such as ionic copolymers of ethylene and an unsaturated monocarboxylic acid which are available under the trademark "SURLYN" of E. I. DuPont de Nemours & Company of Wilmington, Del. or "IOTEK" or "ESCOR" from Exxon. These are copolymers or terpolymers of ethylene and methacrylic acid or acrylic acid partially neutralized with zinc, sodium, lithium, magnesium, potassium, calcium, manganese, nickel or the like.

In another embodiment, the covers 16, 60, and 216 can be formed from mixtures or blends of zinc, lithium and/or sodium ionic copolymers or terpolymers.

Also, Surlyn® resins for use in the cover are ionic copolymers or terpolymers in which sodium, lithium or zinc salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

The invention can likewise be used with covers having one or more homopolymeric or copolymeric materials, such as:

(1) Vinyl resins such as those formed by the polymerization of vinyl chloride, or by the copolymerization of vinyl chloride with vinyl acetate, acrylic esters or vinylidene chloride.

(2) Polyolefins such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using single-site catalyst.

(3) Polyurethanes such as those prepared from polyols and diisocyanates or polyisocyanates and those disclosed in U. S. Pat. No. 5,334,673.

(4) Polyureas such as those disclosed in U.S. Pat. No. 5,484,870.

(5) Polyamides such as poly(hexamethylene adipamide) and others prepared from diamines and dibasic acids, as well as those from amino acids such as poly (caprolactam), and blends of polyamides with Surlyn, polyethylene, ethylene copolymers, ethyl-propylene-non-conjugated diene terpolymer, etc.

(6) Acrylic resins and blends of these resins with poly vinyl chloride, elastomers, etc.

(7) Thermoplastics such as the urethanes, olefinic thermoplastic rubbers such as blends of polyolefins with ethylene-propylene-non-conjugated diene terpolymer, block copolymers of styrene and butadiene, isoprene or ethylene-butylene rubber, or copoly(ether-amide), such as PEBAX sold by ELF Atochem.

(8) Polyphenylene oxide resins, or blends of polyphenylene oxide with high impact polystyrene as sold under the trademark "Noryl" by General Electric Company, Pittsfield, Mass.

(9) Thermoplastic polyesters, such as polyethylene terephthalate, polybutylene terephthalate, polyethylene terephthalate/glycol modified and elastomers sold under the trademarks "Hytrel" by E. I. DuPont de Nemours & Company of Wilmington, Del. and "Lomod" by General Electric Company, Pittsfield, Mass.

(10) Blends and alloys, including polycarbonate with acrylonitrile butadiene styrene, polybutylene terephthalate, polyethylene terephthalate, styrene maleic anhydride, polyethylene, elastomers, etc. and polyvinyl chloride with acrylonitrile butadiene styrene or ethylene vinyl acetate or other elastomers. Blends of thermoplastic rubbers with polyethylene, propylene, polyacetal, nylon, polyesters, cellulose esters, etc.

The cover may also be formed of materials, such as Balata, ionomer, metallocene catalyzed polymers, polyurethane or a combination of the foregoing. Preferably, the cover is comprised of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethelyne vinyl alcohol), poly(tetrafluoroethylene) and their copolymers including functional comonomers and blends thereof. Still further, the cover is preferably comprised of a polyether or polyester thermoplastic urethane, a thermoset polyurethane, an ionomer such as acid-containing ethylene copolymer ionomers, including E/X/Y terpolymers where E is ethylene, X is an acrylate or methacrylate-based softening comonomer present in 0 to 50 weight percent and Y is acrylic or methacrylic acid present in 5 to 35 weight percent. More preferably, in a low spin rate embodiment designed for maximum distance, the acrylic or methacrylic acid is present in 15 to 35 weight percent, making the ionomer a high modulus ionomer. In a high spin embodiment, the cover includes an ionomer where an acid is present in 10 to 15 weight percent and includes a softening comonomer.

When golf balls are prepared according to the invention, they typically will have dimple coverage greater than about 60 percent, preferably greater than about 65 percent, and more preferably greater than about 70 percent. The flexural modulus of the cover on the golf balls, as measured by ASTM method D-790, is typically greater than about 500 psi, and is preferably from about 500 psi to 150,000 psi. The hardness of the cover is typically from about 35 to 80 Shore D, preferably from about 40 to 78 Shore D, and more preferably from about 45 to 75 Shore D.

The resultant golf balls typically have a coefficient of restitution of greater than about 0.7, preferably greater than about 0.75, and more preferably greater than about 0.78. The golf balls also typically have an Atti compression of at least about 40, preferably from about 50 to 120, and more preferably from about 60 to 100.

Figure 11:
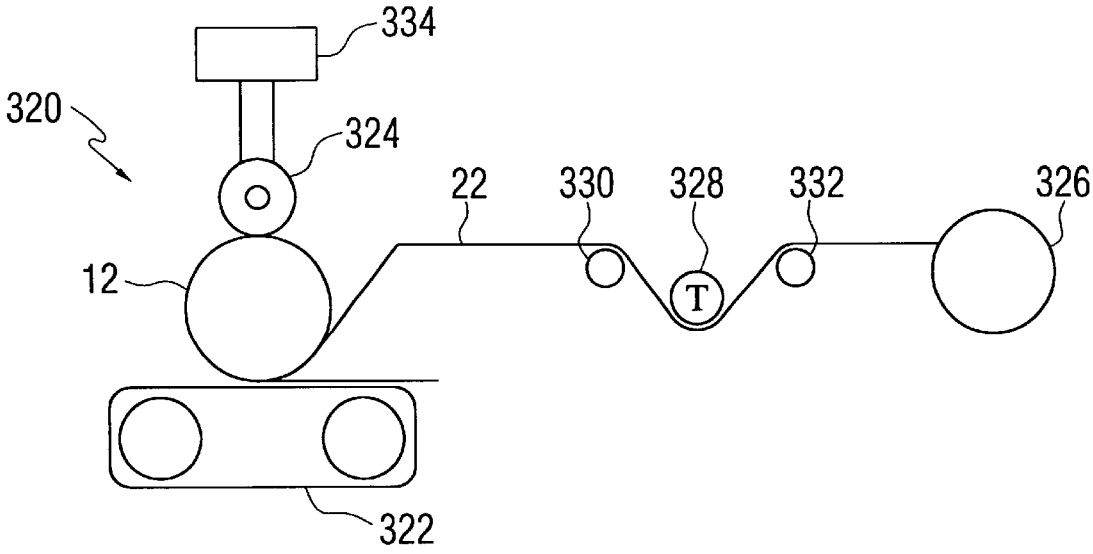
FIG. 11 is a schematic view of a winding apparatus for forming the golf ball of the present invention.

Referring to FIG. 11, the method and winding machine 320 for forming golf ball 10 will now be discussed. The center, such as solid center 12, is placed on a drive belt 322. A support roller 324 is placed against the center 12 such that the support roller 324 applies a force against the center 12 to maintain the center against the drive belt 322. When the drive belt 322 is rotated, the center 12 is forced to spin because the center is held against drive belt 322. Thread 22 is fed from thread feed supply or spool 326 and through a tension controller 328. Preferably, the tension controller 328 is a magnetic tension control. More preferably, guide rollers 330 and 332 are located on either side of the tension controller 328 to assist in aligning the thread 22 to the center 12. The tension controller 328 stretches the thread 22, and then the thread 22 is fed onto the spinning center 12.

When the center 12 and wound layer reach a predetermined pre-fused diameter, a sensor 334 attached to the support roller 324 recognizes the size of the wound core and stops rotation of the drive belt 322, thus stopping rotation of the center 12 and stopping the thread 22 feed. The thread 22 is then cut and heated to cement the free end of the thread in place, and the center 12 is removed from the drive belt 322. Preferably, the pre-fused diameter is greater than the desired post-fused diameter of the center and The manufacturing process for wound cores is such that the thread 22 is preferably elongated during the winding process and then remains in the elongated state permanently. Tension during winding of the present invention maybe varied. This is done by starting the winding at one tension and then increasing or deceasing the tension after a predetermined time. The tensions and angles for winding the thread are predetermined. In an alternative embodiment, the thread can be wound without applying tension; however, tensioning the thread is preferred. The other ball embodiments discussed above with single threads arc also wound using the above method One preferred apparatus and method is described in U.S. patent application Ser. No. 09/610,607 filed on even date herewith, entitled "Golf Ball Winding Apparatus and Method", which is incorporated by reference herein in its entirety.

Alternatively, multiple separate threads can be wound on the core as previously described with respect to FIG. 7. If more than one thread is wound, preferably each read has its own feed supply 326, guide rollers 330 and 332 and tension controller 328, as shown in FIG. 11, to direct the thread to the center. Preferably the threads are different from each other, either in cross-sectional area, thickness, composition, elongated state, physical properties or mechanical properties, for example, when the more than one thread is wound around a center, threads having different modulus may be wound simultaneously. U.S. patent application Ser. No. 09/610,606 filed on even date herewith, entitled "Multiple Thread Golf Ball", is incorporated herein in its entirety.

After wound layer 14 (as shown in FIGS. 1 and 2) is formed, it is fused by applying heat, preferably in combination with pressure, to the wound layer. Preferably, this is accomplished by placing the wound core and a cover material in a compression mold at elevated temperatures. Preferably wound layer 14 is fused simultaneous to forming a cover layer. Preferably, the wound core and cover 16 are compression molded at temperatures between about 250° F. to about 375° F. for between about 1 to about 15 minutes. More preferably the wound core and cover are compression molded at 300° F. for about 5 to about 8 minutes. Alternatively, fusing the wound layer 14 can be done as a separate procedure before molding a cover layer over the wound layer.

Referring to FIGS. 2, 5A, 5B, 6, 6A, 6B, and 6C, the outer radially extending portions 14*b*, 58*b*, 114*b*, 214*b*, 236*b*, 242*b*, 246*b*, and 252*b* of the respective fused wound layers are substantially fused, while the inner radially extending portions 14*a*, 58*a*, 114*a*, 214*a*, 236*a*, 242*a*, 246*a* and 252*a* are un-fused. The thickness of the fused portion of the wound layer is controlled by the temperature and duration of compression or pressure, where higher temperature and longer application of pressure increase the thickness of the fused portion. The portion of the wound layer closest to the applied heat and pressure is fused to a greater degree than the portion of the wound layer that is furthest from the heat and pressure. Heat and pressure are applied closest to, or on, the outer surface of the wound layer, and as a result, an outermost radially extending portion of the wound layer is fused to a greater extent than the inner radially extending portion of the wound layer. As can be seen in FIG. 2, the thickness R1 of the outer radial portion and the thickness R2 of the inner radial portion make up the fused wound layer thickness. A preferred range of the thickness of the fused portion is between about 10% and about 100% of the wound layer thickness. Preferably, the thickness of the fused portion is between about 25% and about 100% of the wound layer thickness. The thickness of the fused portion will vary with the temperature and time at which fusing occurs.

In an alternative embodiment, application of heat can be by, for example, injection molding, compression and injection molding, or infrared heating alone or combined with injection and compression molding.

The fused portion of the wound layer of the present invention has altered or different properties than an un-fused portion or conventional wound layer. For example, a fused portion of the wound layer typically has a greater density than an un-fused portion of the wound layer because the interstices or air spaces between the windings within the wound layer are at least partially filled, as can be seen in FIGS. 4 and 7. Also, the fused portion can have a different elongated state than the un-fused portion. Preferably, the properties of the radially extending portion of the wound layer are altered after the thread is wound onto the center, such as by applying heat to the radially extending portion.

This allows for design opportunity in weight and inertia of the ball after the winding step is complete and the ball is completely wound. For example, when more portions of the wound layer become fused as described above, and thus more dense, the moment of inertia of the wound layer shifts or adjusts. In addition, the properties of the wound layer can be tailored after winding to create a golf ball with unique spin and compression characteristics.

EXAMPLES

These and other aspects of the present invention may be more fully understood with reference to the following non-limiting examples, which are merely illustrative of the preferred embodiment of the present invention golf ball construction, and are not to be construed as limiting the invention, the scope of which is defined by the appended claims.

Example 1

In one embodiment, a polyether urea thread is wound onto a solid center of a golf ball. The polyether urea thread is made by DuPont de Nemeurs & Company with 1460 DTX and deniers within the range of about 500 to about 5000. The thread is wound on the center at elongations of about 400%. The center has a diameter of 1.45 inches. The thread is wound to a diameter of about 1.56 inches. A Surlyn cover is compression molded over the wound core at 300° F. for 5 minutes, simultaneously fusing the underlying wound layer and forming the cover. The cover has a Shore D hardness of 69. The diameter of the completed ball is about 1.682 inches. The thickness of the fused wound layer is about 0.06 inches, and the entire wound layer was fused.

Example 2

In another embodiment, a thread is wound about a solid center and constitutes the outer surface of the ball. The center has a diameter of 1.45 inches, a compression of about 71.1 and weight of about 1.154 ounces. The thread is LYCRA XA 1460 DTX made by DuPont de Nemeurs & Company. The thread is wound about the center at elongations of about 400% to a diameter of about 1.8 inches. The wound core was then compression molded at 300° F. for 5 minutes to fuse the wound layer and simultaneously form dimples on the outer surface of the wound layer and form a cover. The cover has a Shore D hardness of 54. The diameter of the completed ball is about 1.682 inches. The thickness of the fused wound layer is about 0.12 inches, and the entire wound layer was fused.

While it is apparent that the illustrative embodiments of the invention herein disclosed fulfills the objectives stated above, it will be appreciated that numerous modifications and other embodiments may be devised by those skilled in the art. For example, the present invention could use at least three threads where two or more of the threads may be the same, while the third or other threads are chemically, physically and/or mechanically distinct from the two threads that are the same. The embodiments above can also be modified so that some features of one embodiment are used with the features of another embodiment. Therefore, it will be understood that the appended claims are intended to cover all such modifications and embodiments which come within the spirit and scope of the present invention.

We claim:

1. A golf ball comprising:

a) a center; and b) a first wound layer comprising at least one first thread and portions of the first thread are fused together, wherein the at least one fused first thread portion comprises polyether urea, polyester urea, or polyester block copolymers; and c) a second wound layer comprising at least one second thread and portions of the second thread are fused together.

2. The golf ball of claim 1, wherein the golf ball comprises a cover having at least one of a dimple coverage of greater than about 60 percent, a hardness from about 35 to 80 Shore D, or a flexural modulus of greater than about 500 psi, and wherein the golf ball has at least one of a compression from about 50 to 120 or a coefficient of restitution of greater than about 0.7.

3. The golf ball of claim 1, wherein first wound layer has a first fused thread portion and a second un-fused thread portion.

4. The golf ball of claim 3, wherein the thread is a single continuous thread.

5. The golf ball of claim 1, wherein first wound layer further comprises at least two separate threads.

6. The golf ball of claim 5, wherein the at least two separate threads have different compositions.

7. The golf ball of claim 6, wherein at least one of the two separate threads is fusible and the other is non-fusible.

8. The golf ball of claim 7, wherein the at least two separate threads are formed of a fusible material.

9. The golf ball of claim 1, further comprising a cover.

10. The golf ball of claim 9, wherein the ball further includes at least one intermediate layer disposed between the wound layers and the cover layer.

11. The golf ball of claim 9, wherein the ball further includes at least one intermediate layer disposed between the center and the wound layers.

12. The golf ball of claim 1, wherein the first thread is a spun polyether urea.

13. The golf ball of claim 12, wherein the first thread has an elastic modulus of about 30 ksi or greater when elongated between about 200 and about 400%.

14. The golf ball of claim 1, wherein at least one wound layer includes a radially extending fused portion, wherein the radially extending portion forms from about 10% to about 100% of the thickness of the wound layer.

15. A method of forming a golf ball, the method comprising the steps of:

a) winding a first thread onto a center to form a first wound layer, wherein the first thread comprises polyether urea, polyester urea, or polyester block copolymers;

b) fusing portions of the first thread together;

c) winding a second thread onto a center to form a second wound layer, and d) fusing portions of the second thread together.

16. The method of claim 15, wherein the step of winding the first thread further comprises winding until the corresponding first wound layer reaches a pre-fused diameter, after fusing the ball has a post-fused diameter, wherein the pre-fused diameter is greater than the post-fused diameter.

17. The method of claim 15, wherein the step of winding the first thread further includes applying tension to the first thread.

18. The method of claim 15, wherein the step of fusing the first wound layer further includes applying heat to the first wound layer.

19. The method of claim 15, wherein the step of fusing the first wound layer further includes applying pressure to the first wound layer.

20. The method of claim 18, wherein the step of applying heat further includes at least one of the following: compression molding, injection molding, compression and injection molding, or infrared heating.

21. The method of claim 15, wherein the step of fusing the second wound layer further includes applying heat to the second wound layer to form a cover over the second wound layer.

22. The method of claim 15, further comprising forming a cover over the second wound layer.

23. The method of claim 15, further comprising altering the properties of a radially extending portion of the first or second wound layer by applying heat after completing the corresponding first or second winding step.

24. The method of claim 23, wherein the step of altering the properties of the first or second wound layer further includes altering the density of the radially extending portion.

25. The method of claim 23, wherein the step of altering the properties of the first or second wound layer further includes altering the elongation state of the thread in the radially extending portion.

* * * * *